US006474743B1

(12) United States Patent
Harker et al.

(10) Patent No.: US 6,474,743 B1
(45) Date of Patent: Nov. 5, 2002

(54) WHEELCHAIR BACK SUPPORT ASSEMBLY

(75) Inventors: Ruth Harker, St. Louis, MO (US); Brian Cummings, Grand Haven, MI (US); Robert Sparacio, Downers Grove, IL (US); Jill Sparacio, Downers Grove, IL (US)

(73) Assignee: Crown Therapeutics, Inc., Belleville, IL (US)

( * ) Notice: Subject to any disclaimer, the term of this patent is extended or adjusted under 35 U.S.C. 154(b) by 0 days.

(21) Appl. No.: 09/664,184

(22) Filed: Sep. 18, 2000

(51) Int. Cl.[7] ..... A47C 7/36

(52) U.S. Cl. ..... 297/440.21; 297/440.2; 297/354.11

(58) Field of Search ..... 297/440.2, 440.21, 297/354.11

(56) References Cited

U.S. PATENT DOCUMENTS

| | | | | | |
|---|---|---|---|---|---|
| 562,606 | A | * | 6/1896 | Henry | 297/440.2 |
| 1,852,811 | A | * | 4/1932 | Koken et al. | 297/440.21 |
| 3,525,549 | A | * | 8/1970 | Knabusch et al. | 297/440.21 |
| 3,880,463 | A | | 4/1975 | Shephard et al. | |
| 4,313,637 | A | | 2/1982 | Barley | |
| 4,629,246 | A | | 12/1986 | Fulton | |
| 4,647,066 | A | | 3/1987 | Walton | |
| 4,655,471 | A | | 4/1987 | Peek | |
| 4,732,423 | A | | 3/1988 | Condon | |
| 4,753,482 | A | | 6/1988 | Warren | |
| 4,890,888 | A | * | 1/1990 | Kostin | 297/443 |
| 4,981,325 | A | | 1/1991 | Zacharkow | |
| 5,035,467 | A | | 7/1991 | Axelson et al. | |
| 5,062,677 | A | | 11/1991 | Jay et al. | |
| 5,102,195 | A | | 4/1992 | Axelson et al. | |
| 5,127,709 | A | * | 7/1992 | Rubinstein et al. | 297/444 |
| D329,771 | S | | 9/1992 | Zacharkow | |
| 5,149,173 | A | | 9/1992 | Jay et al. | |
| 5,156,226 | A | | 10/1992 | Boyer et al. | |
| 5,176,706 | A | | 1/1993 | Lee | |
| 5,211,446 | A | | 5/1993 | Jay et al. | |
| 5,228,747 | A | | 7/1993 | Greene | |
| 5,269,589 | A | * | 12/1993 | Brothers et al. | 297/440.16 |
| 5,297,021 | A | | 3/1994 | Koerlin et al. | |
| 5,314,239 | A | | 5/1994 | Edwards et al. | |
| 5,344,211 | A | | 9/1994 | Adat et al. | |
| 5,352,023 | A | | 10/1994 | Jay et al. | |
| 5,364,162 | A | * | 11/1994 | Bar et al. | 297/284.8 |
| 5,366,277 | A | | 11/1994 | Tremblay | |
| 5,407,248 | A | | 4/1995 | Jay et al. | |
| 5,447,356 | A | | 9/1995 | Snijders | |
| 5,501,507 | A | | 3/1996 | Hummitzsch | |
| 5,503,459 | A | | 4/1996 | White | |

(List continued on next page.)

FOREIGN PATENT DOCUMENTS

| | | |
|---|---|---|
| DE | 226408 | 3/1963 |
| DE | 2222532 | 11/1973 |
| EP | 026668 | 9/1980 |
| IT | 560109 | 4/1957 |

OTHER PUBLICATIONS

Pin Dot Products: Designing the Future of Rehab Seating; 48 pgs.

*Primary Examiner*—Lanna Mai
*Assistant Examiner*—Phi Dieu Tran A
(74) *Attorney, Agent, or Firm*—Polster, Leider, Woodruff & Lucchesi, L.C.

(57) ABSTRACT

A wheelchair back support assembly is both lightweight and sturdy, is designed to be inexpensively retrofit to an existing wheelchair of tubular frame construction, is designed to comfortably support the back of wheelchair user's of different sizes and having different physical characteristics and also flexes and moves relative to the wheelchair in response to movements of the back, shoulders and arms of the wheelchair user to thereby provide comfortable dynamic support to the back of the wheelchair user.

27 Claims, 5 Drawing Sheets

U.S. PATENT DOCUMENTS 5,518,294 A 5/1996 Ligon, Sr. et al.
5,524,969 A 6/1996 Harrison et al.
5,524,971 A 6/1996 Jay et al.
5,538,326 A 7/1996 Lorbiecki
5,547,251 A 8/1996 Axelson
5,549,357 A 8/1996 Counts et al.
5,553,917 A 9/1996 Adat et al.
5,556,168 A 9/1996 Dinsmoor, III et al.
5,564,788 A 10/1996 Warhaftig
5,567,095 A 10/1996 James et al.
5,573,302 A 11/1996 Harrison et al.
5,582,464 A 12/1996 Maymon
5,593,211 A 1/1997 Jay et al.
5,624,158 A 4/1997 Adat et al.
5,647,637 A 7/1997 Jay et al.
5,678,891 A 10/1997 O'Neill et al.
5,681,092 A 10/1997 Hanson et al.
5,695,245 A 12/1997 Carlson et al.
5,722,725 A 3/1998 McNaughton
5,791,733 A 8/1998 Van Hekken et al.
5,791,735 A 8/1998 Helman
D407,353 S 3/1999 Bar et al.
5,884,928 A 3/1999 Papac
D408,767 S 4/1999 Bar et al.
5,904,398 A 5/1999 Farricielli
5,906,416 A 5/1999 Rasmussen
D412,685 S 8/1999 Bar et al.
D413,085 S 8/1999 Bar et al.
5,944,385 A 8/1999 Pearce
D413,841 S 9/1999 Bar et al.
5,984,418 A 11/1999 McInturff
5,996,716 A 12/1999 Montiglio et al.
6,089,664 A 7/2000 Yoshida
6,095,611 A 8/2000 Bar et al.
6,125,851 A 10/2000 Walker et al.
RE37,026 E * 1/2001 Whalen ..... 297/361.1
6,305,747 B1 * 10/2001 Mei ..... 297/354.11

* cited by examiner

WHEELCHAIR BACK SUPPORT ASSEMBLY

BACKGROUND OF THE INVENTION

1) Field of the Invention

The present invention pertains to a wheelchair back support assembly that is designed to be retrofit to a wheelchair or to replace an existing back support of a wheelchair. The wheelchair back support assembly has a simple construction that is both lightweight and sturdy and includes a back support panel that can be contoured to match the back of the wheelchair user and springs that permit the back support to comfortably flex in response to movements of the back of the wheelchair user.

2) Description of the Related Art

Wheelchairs have various different constructions but many are constructed of tubular metal members that are connected together to form a rigid frame of the wheelchair. A wheelchair 10 of this type is shown in FIGS. 1 and 2. The metal construction of the wheelchair tubular members significantly contributes to the overall weight of the wheelchair. As seen in FIGS. 1 and 2, the tubular frame members include two side horizontal frame members 12 and one rear horizontal frame member 14 that are connected together to form a support for the seat of the wheelchair. Many of the connections between the tubular frame members of the wheelchair are telescoping connections where an end of one member is inserted into an end of another member. The connections are then secured by threaded fasteners, by spring biased detents, or by other equivalent means. The seat of the wheelchair shown is a soft "sling" type seat that is constructed of a piece of sturdy fabric 16 stretched across the side horizontal frame members 12 and in front of the rear horizontal frame member 14. The horizontal frame members 12, 14 are supported on the wheels of the wheelchair by a framework 18 of tubular members. The framework includes a pair of rear, lower vertical frame members 20 that are connected to the rear wheels 22 of the wheelchair. The pair of lower vertical frame members 20 are also connected with the side horizontal frame members 12 and the rear horizontal frame member 14 and terminate at their top ends (not shown) adjacent the horizontal frame members. An upper pair of vertical frame members 24 are connected to the top ends of the pair of vertical frame members 20.

The upper pair of vertical frame members 24 extend upwardly from the horizontal frame members 12, 14 to bent upper ends 26 of the vertical frame members that function as the handles of the wheelchair. This additional pair of vertical frame members 24 at the rear of the wheelchair are commonly referred to as the "canes" of the wheelchair due to their shape. They support a soft "sling" type back 28 of the wheelchair that is commonly constructed of a piece of sturdy fabric. The pair of vertical canes 24 are often telescopically attached to the upper ends of the lower vertical frame members 20 attached to the wheelchair rear wheels. The canes 24 are secured to the lower vertical frame members 20 by threaded nut and bolt fasteners inserted through aligned holes of the frame members, by spring biased detents or by other equivalent means as discussed above.

In many prior art wheelchairs constructed of tubular frames similar to the wheelchair discussed above, there is no adjustability or only limited adjustability of the tubular frame members to accommodate wheelchair users of different physical characteristics, for example different sizes and different weights. In addition, wheelchairs with tubular frame members often have their back supports fixed rigidly to their seat supports, providing no adjustment of the back support to accommodate users of the wheelchair having different physical characteristics. Should a user of a wheelchair desire a specific configuration of a back support on the wheelchair to either accommodate their larger size or to more comfortably support their back, the wheelchair user was often required to purchase an entire new wheelchair that incorporated the specialized options such as a wider back support or a back support that tilts.

What is needed to overcome these disadvantages of existing wheelchairs is a back support assembly that is both lightweight and sturdy, is designed to be inexpensively retrofit to an existing wheelchair frame, is designed to comfortably support the back of wheelchair users of different sizes and having different physical characteristics, and also flexes and moves relative to the wheelchair in response to movements of the back, shoulders and arms of the wheelchair user to thereby provide comfortable dynamic support to the back of the wheelchair user.

SUMMARY OF THE INVENTION

The wheelchair back support assembly of the present invention overcomes the disadvantages associated with rigid, uncomfortable wheelchair back supports of wheelchair's having tubular frame members by providing a back support assembly that can be inexpensively retrofit to an existing wheelchair frame replacing its original back support and which flexes and moves in response to movements of the wheelchair user.

The back support assembly of the invention includes a padded back panel constructed of composite materials or other similar types of materials that can be specifically molded or shaped in different sizes to conform to the back configurations of the wheelchair users of different sizes. The back panel is connected between a pair of side columns that have mounting poles at their bottom ends. The mounting poles are specifically designed to be telescopically received on tubular frame members of an existing wheelchair in place of the back support or canes of the wheelchair. The mounting poles are attached to the side columns of the back support assembly by inclination adjustment mechanisms that permit an adjustment of the angle of inclination of the back panel. In addition, the inclination adjustment mechanisms are connected to the side columns by a pair of spring assemblies that allow the back panel to flex comfortably relative to the mounting poles of the back support assembly. The pair of spring assemblies are mounted to the side columns by connectors that can be adjustably positioned along the lengths of the side columns, thereby adjusting the vertical position of the back panel relative to the wheelchair. In addition, the back panel is provided with a centered manual handle or, alternatively, a pair of manual handles may be attached to the side columns and adjustably positioned along the lengths of the side columns. The side columns are also designed to have additional components such as lateral torso supports and arm rests adjustably attached to the side columns.

The wheelchair back support assembly provides an inexpensive back support with a simple construction of only a few component parts that can be easily retrofit to a tubular frame of an existing wheelchair, replacing the wheelchair's original back support. The back support assembly provides the wheelchair with a back support that can be provided in different sizes for the size and shape of the wheelchair user's back, that can be adjustably positioned both angularly and vertically relative to the wheelchair, and that flexes as the wheelchair user moves on the wheelchair to comfortably support the wheelchair user.

BRIEF DESCRIPTION OF THE DRAWINGS

Further objects and features of the present invention are set forth in the following detailed description of the preferred embodiment of the invention and in the drawing figures wherein.

DETAILED DESCRIPTION OF THE PREFERRED EMBODIMENT

Figure 1:
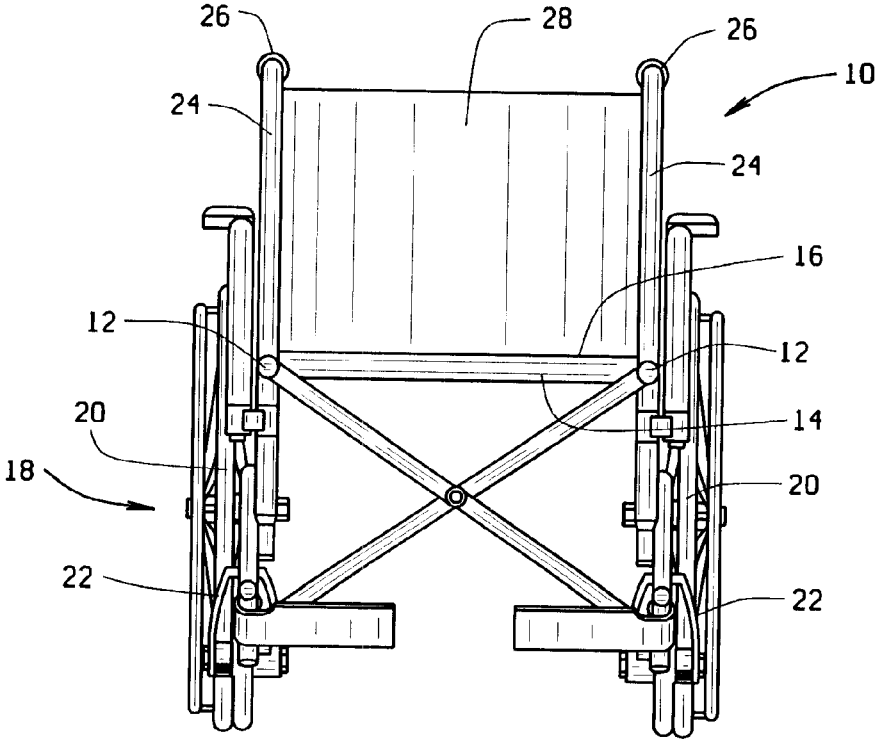
FIG. 1 is a front view of a conventional wheelchair having a frame constructed of tubular frame members.
Figure 2:
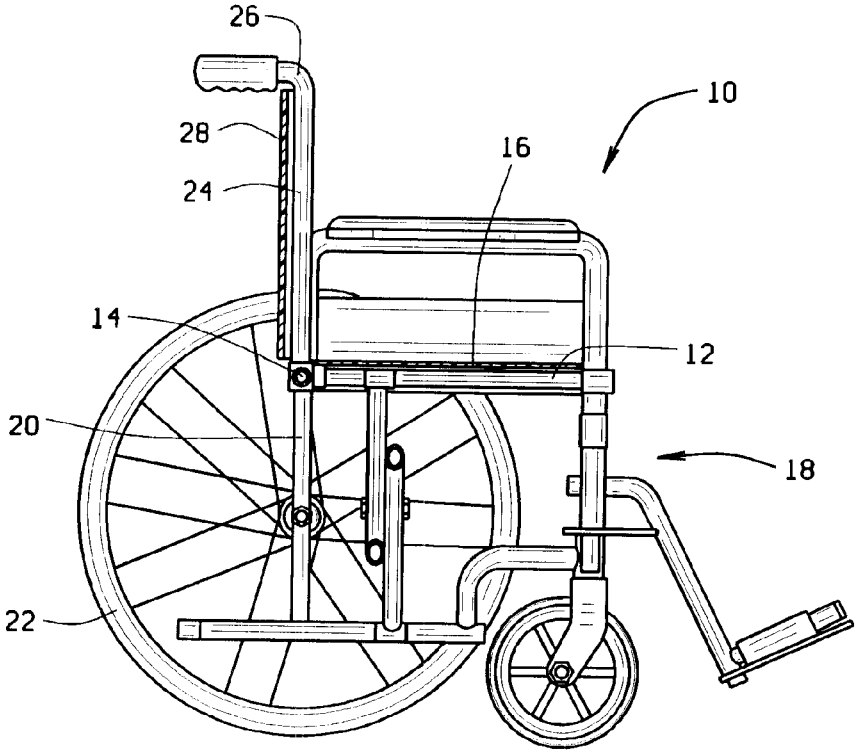
FIG. 2 is a side view of the wheelchair of FIG. 1.
Figure 4:
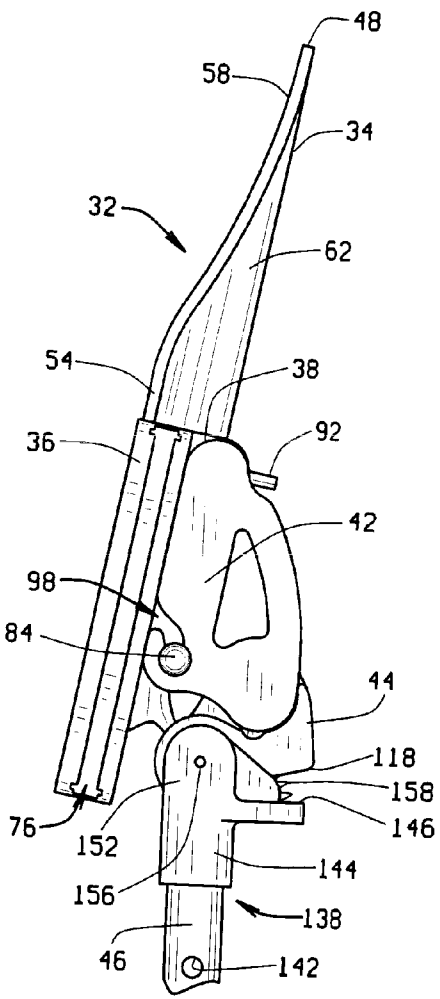
FIG. 4 is a partial left side view of the wheelchair back assembly, the right side view being a mirror image of FIG. 4.
Figure 3:
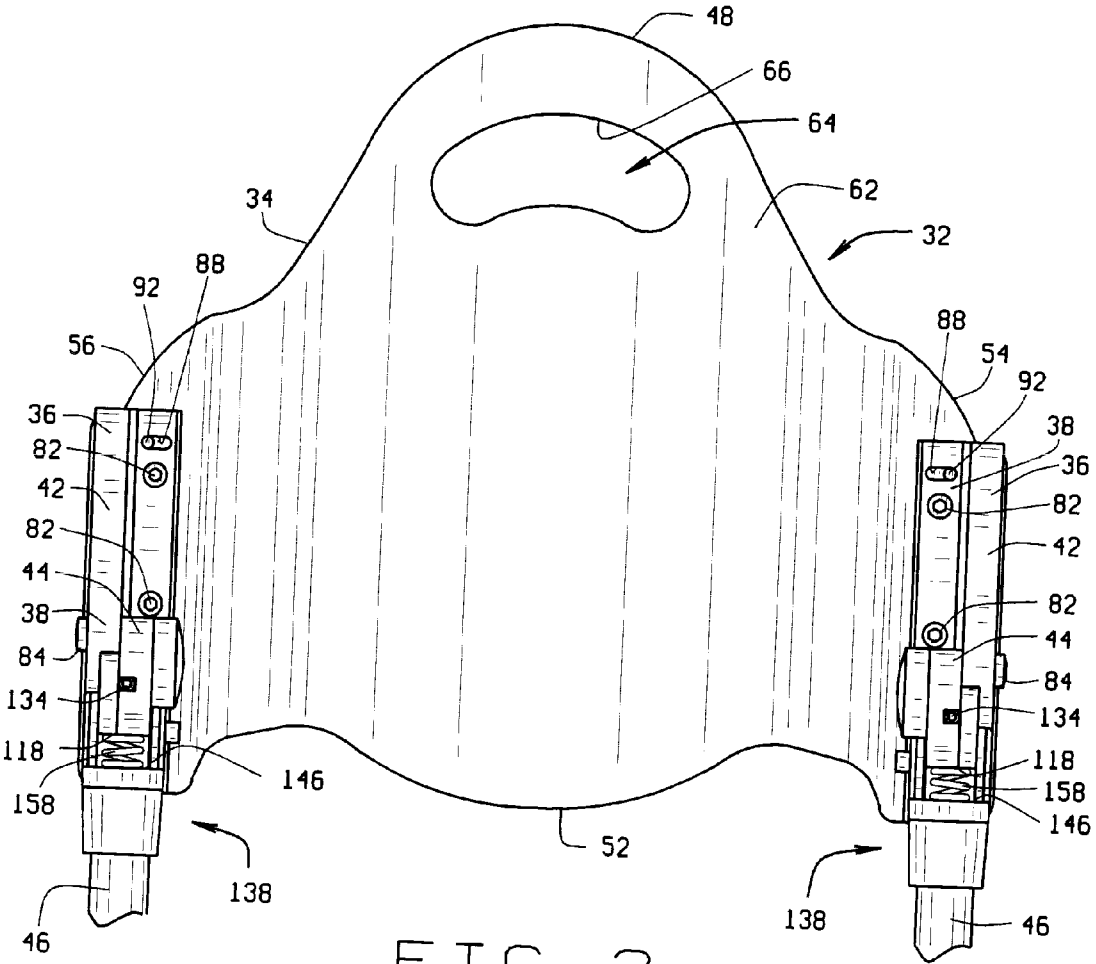
FIG. 3 is a partial view of the wheelchair back assembly of the present invention.

FIG. 3 is a view from the back of the wheelchair back support assembly 32 of the invention. FIG. 4 is a left hand side view of the back support assembly. The back support assembly 32 is basically comprised of a back panel 34, a pair of side columns 36 with side blocks 38 attached to the back panel, a pair of clasps 42 that are attached to the side blocks, a pair of angle adjustment assemblies 44 that attach to the clasps, and a pair of mounting posts 46 that are connected to the angle adjustment assemblies 44 and are adapted for attachment to a wheelchair in place of the vertical frame members or canes 24 of the wheelchair. Each of the basic component parts of the wheelchair back support assembly listed above are preferably constructed of a lightweight yet strong material, for example composite materials such as fiberglass or Twintex®, a material manufactured by Vetrotex France, plastic resins or extruded or stamped aluminum.

Figure 5:
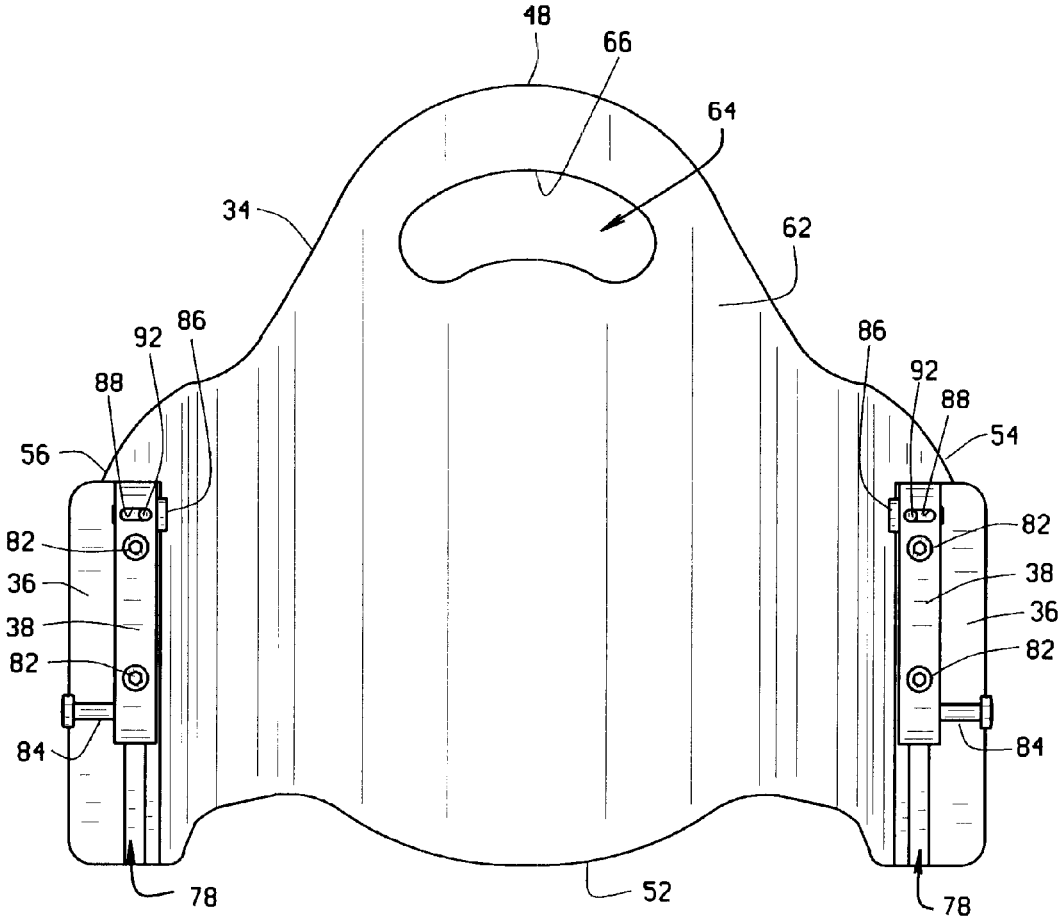
FIG. 5 is a view of the back panel of the wheelchair assembly with mounting posts and their clasps removed.
Figure 6:
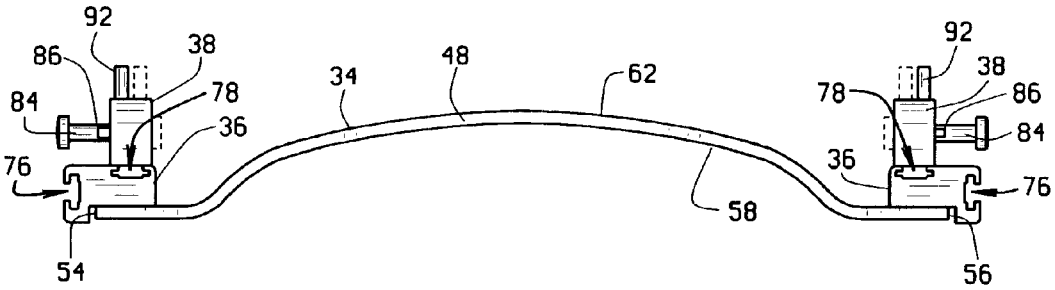
FIG. 6 is a top view of the back panel of FIG. 5.
Figure 7:
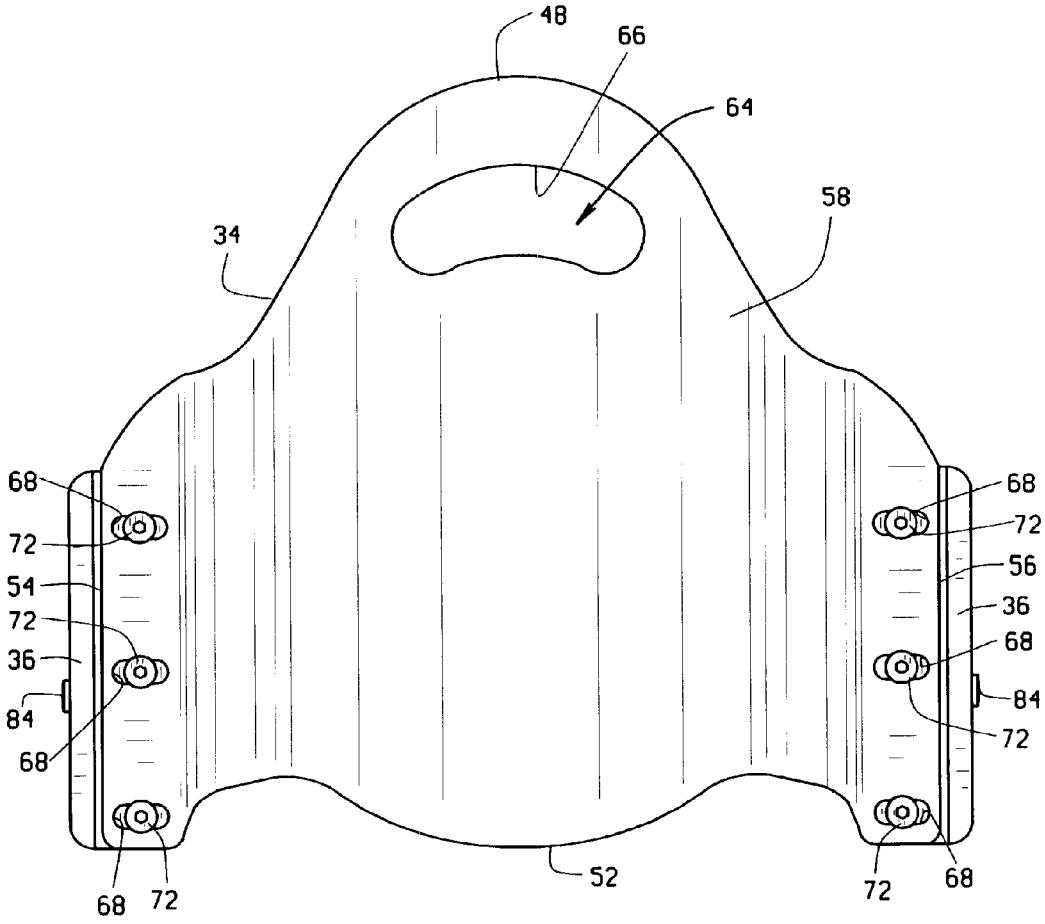
FIG. 7 is a front view of the back panel of FIG. 5.
Figure 8:
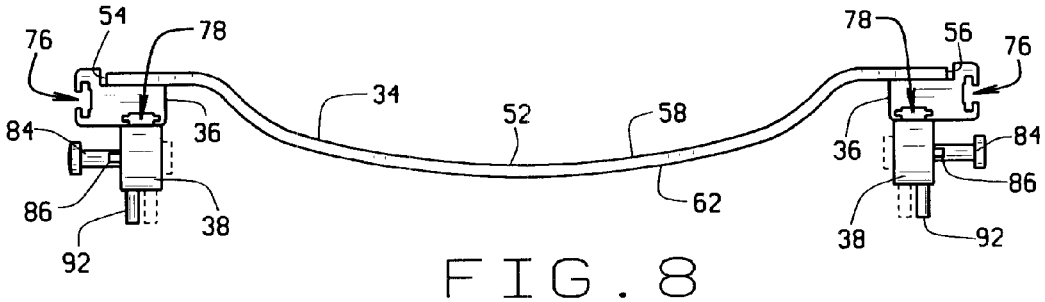
FIG. 8 is a bottom view of the back panel of FIG. 5.

The back panel 34 is preferably constructed of a composite material, however other similar materials may be used. The panel is formed with vertically opposite top 48 and bottom 52 edges and horizontally opposite side edges 54, 56. As seen in FIGS. 6 and 8, the panel 34 is formed with a curved contour with a front surface 58 being concave and a back surface 62 being convex. With the panel being formed by compression molding of a composite material or an other similar process it can be given a specific contoured or curved configuration designed to match and shape and size of a particular user of the wheelchair. Alternatively, the shape and size of the back panel 34 could be specifically designed to fit particular age groups, for example adult, young adult and children, or could be designed to fit particular size and weight groups of wheelchair user's. As seen in FIGS. 5 and 7, the back panel 34 is formed with an opening 64 that defines a handle 66 at the top of the panel, thus eliminating the need to provide separate handles or canes for use with the back support assembly 32. The panel is also formed with pluralities of horizontally oblong openings 68 adjacent the horizontally opposite side edges 54, 56 of the panel. The oblong openings 68 are employed in attaching the pair of side columns 68 to the horizontally opposite side edges 54, 56 of the back panel 34. Although not shown, in use the back panel 34 could have some type of cushion, for example a foam cushion or air cell cushion secured to its front surface 58.

In the embodiment shown the side columns 36 are attached to the rear surface 62 of the back panel by set screws with enlarged heads 72 that pass through the oblong opening 68 of the panel and are screw threaded into complementary internally threaded holes (not shown) in the side columns. The oblong opening 68 enable the side columns 36 to be horizontally adjustably positioned relative to each other and relative to the back panel 34 by moving the set screws 72 of the columns horizontally in the oblong openings, thus enabling adjustment of the side columns to accommodate the wheelchair back assembly 34 to fit the vertical cane supports of various different wheelchairs as will be described. In the preferred embodiment the side columns 36 are formed of extruded aluminum, although other materials may be employed. The columns 36 are formed with side grooves 76 and rear grooves 78 that have general t-shaped cross sections that extend along the vertical lengths of the columns as seen in FIGS. 4 through 6 and 8. The rear grooves 78 are employed in attaching the pair of side blocks 38 to the side columns and the side grooves 76 may be employed in attaching arm rests, lateral torso supports or other similar accessories to the wheelchair in the same manner as the side blocks to be described.

The side blocks 38 are preferably constructed of a rigid, plastic material, although other materials may be employed. Each side block 38 is attached to one of the side columns 36 for vertical adjustable positioning of the side blocks by internally threaded washers (not shown) that are screw threaded on to pairs of set screws 82 on each side block. The internally threaded washers (not shown) are inserted into the rear grooves 78 of the side columns 36, thereby attaching the side blocks 38 to the side columns 36 in a manner that enables the side blocks to slide along the rear grooves 78 to a desired vertically adjusted position of the side blocks 38 relative to the side columns 36. Tightening the set screws 82 of the side blocks 38 secures them in their adjusted positions relative to the side columns 36. This enables a vertical adjustment of the position of the back panel 34 relative to the mounting posts 46. Each of the side blocks 38 is also provided with an attachment post 84 that is used in removeably attaching the back panel 34 to the mounting posts as will be explained. The attachment posts 84 project horizontally outwardly from the two side blocks 38. Each of the side blocks 38 also has a slide pin 86 that is mounted in a horizontal hole (not shown) toward the top of each side block for horizontally reciprocating movement of the slide pin between extended positions shown in dashed lines in FIG. 6 and retracted positions shown in solid lines in FIG. 6. The side blocks 38 have oblong horizontal slots 88 in their rear surfaces that communicate with the horizontal holes of the slide pins 86. Levers 92 extend through the horizontal slots 88 and are secured to the slide pins 86. The levers 92 are used in manually sliding the slide pins 86 between their extended and retracted positions. In the preferred embodiment, a small coil spring (not shown) is also provided in the horizontal hole of the slide pins and biases the slide pins 86 toward their retracted positions.

The clasps 42, the angle adjustment assemblies 44 and the mounting posts 46 make up the mounting members of the wheelchair back support assembly. In FIGS. 9–12 only the right side mounting member is shown. The left side mounting member is a mirror image of the right side mounting member and therefore only the right side mounting member will be described.

In the preferred embodiment the clasps 42 are molded of a rigid plastic material, although other similar materials may be employed. The clasps 42 each have a main body 96 that has the same general configuration of the side columns 36. Each clasp is formed with an angled slot 98 toward the bottom end of the clasp body 96 and a shallow groove 98 with a recessed hole 102 toward the top of the clasp body. A small but powerful permanent magnet 104 is secured in the recesses groove 102 of the clasp. A connector portion 104 of the clasp projects outwardly from the bottom of the main body 96 and an arcuate web or arm 108 connects the connector portion 102 to the top of the clasp main body 96. The connector portion 106 has an internally threaded hole 112 that extends partially through the connector portion and is employed in securing the clasp 96 to the angle adjustment assembly 44 as will be explained. A curved hole 114 is also formed in the bottom surface of the clasp connector portion 106.

In the preferred embodiment the angle adjustment assemblies 44 are molded of a rigid plastic material such as that of the clasps 42, although other similar materials may be employed. The adjustment assemblies 44 are formed with a substantially flat bottom surface 118 and with a pair of lobes 122, 124 projecting upwardly from the bottom surface. A small circular hole 126 is recessed into the bottom surface 118. A first one of the lobes 122 shown to the left in FIG. 9 and to the right in FIG. 10 has a hole 128 passing through its center. The hole receives a set screw 132 with an enlarged head that is screw threaded into the internally threaded hole 112 of the clasp connector, thereby attaching the clasp 42 to the angle adjustment assembly 44. The second of the two lobes 124 shown to the right in FIG. 9 and to the left in FIG. 10 also has a hole (not shown) passing through the center of the lobe. The hole of the second lobe 128 receives a pivot pin in pivotally attaching the angle adjustment assembly 44 to the mounting posts 46 as will be explained. In referring to FIG. 10, the angle adjustment assembly 44 also has an elongate, narrow set screw 134 that is screw threaded transversely through a cylindrical key 136. The right hand end of the set screw 134 passes through a hole in the second lobe 24 of the angle adjustment assembly and the left end of the set screw 134 has an enlarged head received in a recess (not shown) of the angle adjustment assembly. This mounting of the elongate set screw 134 enables it to be rotated in the hole through the second lobe 124 of the adjustment assembly but prevents the set screw from moving axially when rotated. However, rotation of the elongate set screw 134 will cause the cylindrical key 136 to move axially along the length of the set screw. When the clasp 42 is attached to the angle adjustment assembly 44 by the set screw 132 that passes through the first lobe hole 128 and into the internally threaded hole 112 of the clasp, the cylindrical key 136 is received in the hole 124 recessed into the bottom surface of the clasp. Thus, by rotating the elongate set screw 134 in opposite directions the cylindrical key 136 is caused to move in opposite directions axially along the set screw and in turn causes the clasp 142 to pivot about the first lobe hole set screw 132 and thereby adjusts the angle of inclination of the clasp 42 relative to the angle adjustment assembly 44. This enables an adjustment in the angle of inclination of the back panel 34 mounted on the clasps 42 relative to the mounting posts 46 that are mounted to a wheelchair, thus enabling an adjustment of the angle of inclination of the back panel 34 relative to the wheelchair.

Each of the mounting posts 46 has opposite top 138 and bottom 140 ends and in the preferred embodiment are formed from cylindrical tubes of aluminum, although other materials may be employed. The exterior dimension of the mounting post 46 is preferably dimensioned to be received inside the vertical frame members 20 of the wheelchair in place of the canes of the wheelchair. The mounting posts are provided with pluralities of openings 142 along their lengths that are aligned with openings of the wheelchair vertical frame members 20 and through which threaded fasteners are passed to mount the mounting posts in vertically adjusted positions on the wheelchair frame members, in the same manner that the canes 24 are mounted to the wheelchair frame. Alternative mechanisms for attaching the mounting posts 46 to the wheelchair could also be employed. In addition, each mounting post could be constructed of two sections that are screw threaded together. The bottom sections could be selectively attached to the top sections or removed to adapt the mounting posts for use with wheelchairs having lower vertical frame members 20 of different lengths.

Figure 9:
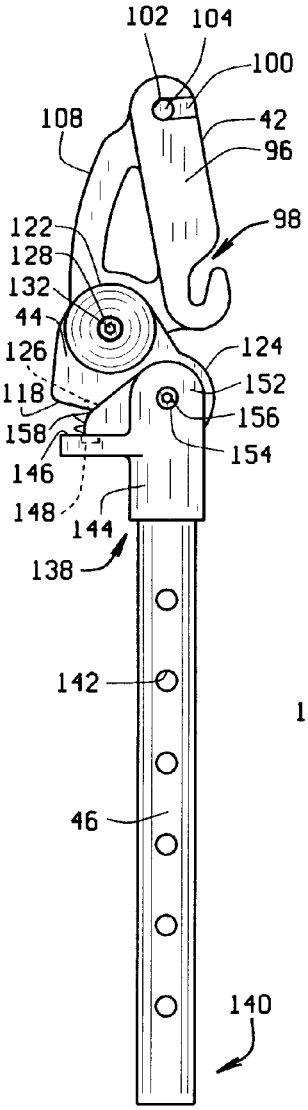
FIG. 9 is a side elevation view of the right side mounting clamp and mounting post of the wheelchair assembly removed from the back panel.
Figure 10:
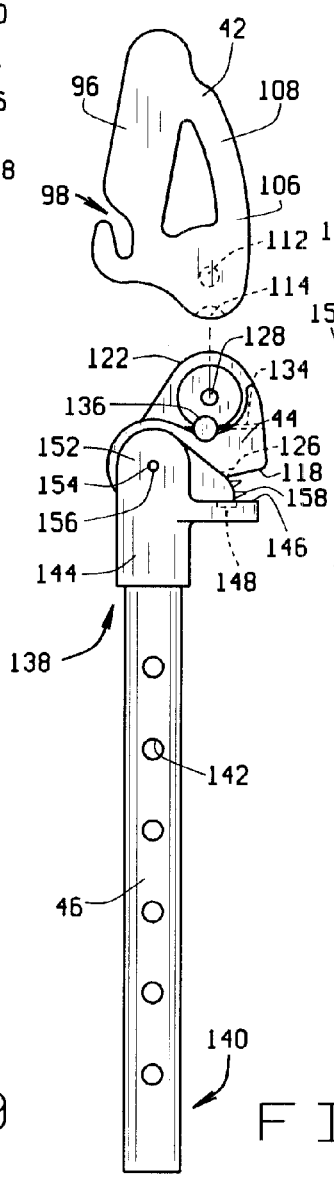
FIG. 10. is a view of the mounting clamp and mounting post of FIG. 9 turned 180° and with the mounting clamp removed from the mounting post.
Figure 11:
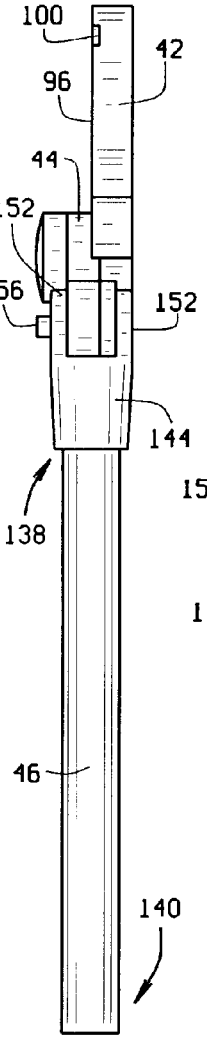
FIG. 11 is a front view of the mounting post of FIG. 9.
Figure 12:
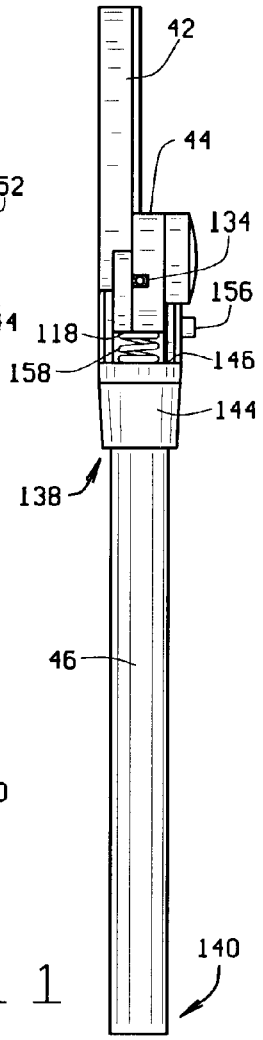
FIG. 12 is a rear view of the mounting post of FIG. 9.

A base of rigid plastic or other similar material is secured to the top end 138 of the mounting posts. The base is formed with a projection having a base surface 146 that opposes the bottom surface 118 of the angle adjustment assembly 44. The base surface 146 has a small circular recess 148 that opposes the circular recess 126 in the adjustment assembly bottom surface 118. Adjacent the base surface 146 the base 144 has a pair of horizontally spaced prongs 152 that project upwardly from the base. The prongs 152 have horizontally aligned center holes 154. The angle adjustment assembly second lobe 124 is received between the prongs 152 with the center hole (not shown) of the second lobe aligned with the base prong center holes 154. A pivot pin 156 is inserted through the aligned holes, thereby mounting the angle adjustment assembly 44 to the base 144 for pivoting movement of the angle adjustment assembly relative to the base. As seen in FIG. 9, the angle adjustment assembly 44 and the attached clasp 42 and the back panel 34 of the wheelchair back assembly can pivot relative to the base 44 and the mounting post 46 between a first, forward position shown in FIG. 9 where the right hand end of the adjustment assembly bottom surface 118 contacts with the right hand end of the base surface 146, and a second rearward position relative to the base and mounting posts where the adjustment assembly bottom surface 118 is substantially parallel with the base surface 146.

A spring 158 is positioned between the adjustment assembly bottom surface 118 and the base surface 146. In the preferred embodiment the spring 158 is a coil spring, however other types of springs may be employed. The spring 158 is received in the hole recessed in the adjustment assembly bottom surface 126 and the hole recessed in the base surface 148. The spring 158 biases the adjustment assembly 44, the clasp 42 and the back panel 34 attached thereto to their forward position shown in FIG. 9. Movement of the angle adjustment assembly 44, the clasp 42 and the back panel 34 to their rearward position acts against the bias of the spring 158 and compresses the spring between the adjustment assembly bottom surface and the base surface 146. Thus, the spring 158 enables the horizontally opposite side edges 54 of the back panel 34 to flex and pivot relative to the mounting posts 46 independently of each other as a wheelchair user's arms and shoulders move about the user's torso in operating the wheelchair.

The wheelchair back assembly of the invention is assembled to the vertical frame members 70 of a wheelchair by inserting the mounting posts 46 into the frame members to a desired vertically adjusted position and then inserting threaded fasteners through aligned holes of the wheelchair vertical frame members 20 and the openings 142 of the mounting posts. Next, the back panel 34 is inserted between the clasps 42 of the mounting members with the side blocks 34 positioned between the clasps. The back panel 34 and side columns 38 are moved downwardly causing the attachment posts 84 of the side blocks to move into the angled grooves 98 of the clasps. With the attachment posts 84 bottomed out in the clasp grooves 98, the installer moves the slide pin levers 92 of the side blocks 38 toward each other causing the slide pins 86 to be retracted into their holes. The side blocks 38 are then moved between the clasps 42 and the installer releases the levers 92 causing the magnets 104 in the recessed holes 102 of the clasps to draw the slide pins 86 out of their holes and into the magnet holes 102, thereby releasably attaching the back panel 34 to the wheelchair mounting members.

The wheelchair back support assembly described above provides an inexpensive back support with a simple construction of only a few component parts that can be easily retrofit to a tubular frame of an existing wheelchair, replacing the wheelchair's original back support. The back support assembly provides the wheelchair with a back support that can be provided in different sizes for the size and shape of the wheelchair user's back, that can be adjustably positioned both angularly, horizontally and vertically relative to the wheelchair, and that flexes as the wheelchair user moves on the wheelchair to comfortably support the back of the wheelchair user.

While the present invention has been described by reference to specific embodiments, it should be understood that modifications and variations of the invention may be constructed without departing from the scope of the invention defined in the following claims.

What is claimed:

1. A wheelchair back assembly comprising:

a back panel dimensioned to support a user's back, the back panel having vertically opposite top and bottom edges and a pair of horizontally opposite side edges;

a pair of back panel clasps, each clasp being removeably attached to one of the side edges of the back panel;

a pair of mounting posts adapted for attachment to a wheelchair, each mounting post having one of the clasps mounted thereon for movement of the clasp between first and second positions of the clasp relative to the mounting post; and a pair of springs, each spring being operatively connected to a mounting post and the clasp mounted on the mounting post for biasing the clasp toward the first position of the clasp relative to the mounting post.

2. The wheelchair back assembly of claim 1, wherein:

the pair of back panel clasps are mounted to the pair of mounting posts by a pair of pivot connections that enable the back panel clasps to pivot relative to the mounting posts between the first and second positions of the clasps relative to the mounting posts.

3. The wheelchair back assembly of claim 1, wherein:

the pair of back panel clasps are mounted to the pair of mounting posts by angle adjustment assemblies that enable adjusting a relative angle between each clasp and mounting post.

4. The wheelchair back assembly of claim 1, wherein:

the pair of mounting posts have opposite top and bottom ends and the post bottom ends are adapted for attachment to a wheelchair;

the pair of pivot connections each include a base mounted to the top end of one of the mounting posts and a pivot pin that operatively connects one of the clasps to the base for pivoting movement of the clasp about the pivot pin between the first and second positions of the clasp relative to the mounting post.

5. The wheelchair back assembly of claim 4, wherein:

the base has a base surface and one of the springs is positioned between the base surface and the clasp.

6. The wheelchair back assembly of claim 5, wherein:

the spring is a coil spring that is compressed when the clasp is moved toward the second position of the clasp relative to the mounting post.

7. The wheelchair back assembly of claim 5, wherein:

the pair of back panel clasps are mounted to the pair of mounting posts by angle adjustment assemblies that are connected to the clasps and are connected to the pivot connection bases by the pivot pins that enable pivoting of the angle adjustment assemblies and the clasps relative to the pivot connection bases, where the angle adjustment assemblies enable adjusting a relative angle between each clasp and mounting post.

8. The wheelchair back assembly of claim 1, wherein:

the pair of springs are coil springs that each are operatively connected between one of the mounting posts and one of the clasps and are compressed when the clasps are moved toward the second positions of the clasps relative to the mounting posts.

9. The wheelchair back assembly of claim 1, wherein:

the pair of back panel clasps have slots and the back panel has a pair of attachment posts that are engaged in the slots in removeably attaching the back panel to the pair of clasps.

10. The wheelchair back assembly of claim 1, wherein:

the pair of back panel clasps have holes; and a pair of slide pins are mounted on the back panel for sliding movement of the pins between engaged and disengaged positions of the pins relative to the back panel, where in the engaged positions of the pins they extend into the holes of the back panel clasps and hold the back panel to the back panel clasps and in the disengaged positions of the pins they are retracted out of the holes of the back panel clasps and enable the back panel to be removed from the back panel clasps.

11. The wheelchair back assembly of claim 10, wherein:

magnets are positioned in the holes of the back panel clasps and bias the slide pins into the holes in the back panel clasps.

12. The wheelchair back assembly of claim 1, wherein:

the pair of back panel clasps are removeably attached to the back panel at positions on the back panel that can be vertically adjusted.

13. A wheelchair back assembly comprising:

a back panel dimensioned to support a user's back, the back panel having vertically spaced top and bottom edges and a pair of horizontally spaced side edges;

mounting members attached to the back, the mounting members being adapted for attachment to a wheelchair and including a pair of clasps that are attached to the back panel and a pair of bases that are each connected to a clasp by a pivoting connection that enables the clasps and the back panel to pivot relative to the pair of bases between a forward and a rearward position of the back panel; and springs on the mounting members between each clasp and base biasing the back panel toward the forward position.

14. A wheelchair back assembly of claim 13, wherein: the springs are coil springs that are compressed when the back panel is moved toward the rearward position.

15. The wheelchair back assembly of claim 13, wherein: the springs are coil springs that are compressed between the clasps and bases when the back panel is moved toward the rearward position.

16. The wheelchair back assembly of claim 13, wherein: the pair of clasps are connected to a pair of angle adjustment assemblies that are each connected to one of the pair of bases by a pivot connection thereby providing the pivoting connection between the clasps and the bases, the angle adjustment assemblies enabling adjusting a relative angle between each clasp and mounting member.

17. The wheelchair back assembly of claim 13, wherein: the mounting members include a pair of mounting posts having opposite top and bottom ends, the bottom ends of the mounting posts are adapted for attachment to a wheelchair, and each of the pair of bases are mounted to the top end of one of the mounting posts.

18. The wheelchair back assembly of claim 13, wherein: the pair of back panel clasps have slots and the back panel has a pair of attachment posts that are engaged in the slots in removeably attaching the back panel to the pair of clasps.

19. The wheelchair back assembly of claim 13, wherein: the pair of back panel clasps have holes; and a pair of slide pins are mounted on the back panel for sliding movement of the pins between engaged and disengaged positions of the pins relative to the back panel, where in the engaged positions of the pins they extend into the holes of the back panel clasps and hold the back panel to the back panel clasps and in the disengaged positions of the pins they are retracted out of the holes of the back panel clasps and enable the back panel to be removed from the back panel clasps.

20. The wheelchair back assembly of claim 13, wherein:

magnets are positioned in the holes of the back panel clasps and bias the slide pins into the holes in the back panel clasps.

21. The wheelchair back assembly comprising: a back panel dimensioned to support a user's back, the back panel having vertically spaced top and bottom edges and horizontally spaced side edges and a pair of attachment posts adjacent the side edges; a pair of back panel clasps each having a slot that receives one of the attachment posts is removeably attaching the back panel to the pair of clasps; a pair of mounting posts attached to the pair of clasps for movement of the back panel between forward and rearward positions of the back panel relative to the pair of mounting posts; and a pair of springs on the mounting posts that bias the back panel toward the forward position of the back panel.

22. The wheelchair back assembly of claim 21, wherein:

the pair of back panel clasps have holes; and a pair of slide pins are mounted on the back panel for sliding movement of the pins between engaged and disengaged positions of the pins relative to the back panel, where in the engaged positions of the pins they extend into the holes of the back panel clasps and hold the back panel to the back panel clasps and in the disengaged positions of the pins they are retracted out of the holes of the back panel clasps and enable the back panel to be removed from the back panel clasps.

23. The wheelchair back assembly of claim 22, wherein:

magnets are positioned in the holes of the back panel clasps and bias the slide pins into the holes in the back panel clasps.

24. The wheelchair back assembly of claim 21, wherein:

the springs are coil springs that are compressed when the back panel is moved toward the rearward position.

25. The wheelchair back assembly of claim 21, wherein:

the pair of mounting posts have opposite top and bottom ends and the post bottom ends are adapted for attachment to a wheelchair;

a base is mounted to the top end of each mounting post and a pivot pin operatively connects one of the back panel clasps to each base for pivoting movement of the clasp and back panel about the pivot pin between the forward and rearward positions of the back panel.

26. The wheelchair assembly of claim 25, wherein:

the base has a base surface and one of the springs is positioned between the base surface and the clasp.

27. The wheelchair back assembly of claim 26, wherein:

the spring is a coil spring that is compressed when the back panel is moved toward the rearward position.

* * * * *